United States Patent [19]

Ayano et al.

[11] Patent Number: 4,767,263

[45] Date of Patent: Aug. 30, 1988

[54] LIQUID DRAINING DEVICE FOR A STEAM TURBINE

[75] Inventors: Shinya Ayano, Fujisawa; Yasuo Ojiro, Yokohama, both of Japan

[73] Assignee: Kabushiki Kaisha Toshiba, Kawasaki, Japan

[21] Appl. No.: 105,613

[22] Filed: Oct. 8, 1987

[30] Foreign Application Priority Data

Oct. 14, 1986 [JP] Japan ..... 61-241955

[51] Int. Cl.[4] ..... F04D 29/70

[52] U.S. Cl. ..... 415/121 A; 60/646; 60/657

[58] Field of Search ..... 415/121 A, 168; 60/646, 60/657

[56] References Cited

U.S. PATENT DOCUMENTS 2,292,291 8/1942 Roe ..... 415/121 A
2,485,447 10/1949 Keller ..... 60/657
4,353,213 10/1982 Masuda et al. ..... 60/646
4,434,620 3/1984 Ishimaru et al. ..... 60/657

*Primary Examiner*—Robert E. Garrett
*Assistant Examiner*—John T. Kwon
*Attorney, Agent, or Firm*—Foley & Lardner, Schwartz, Jeffery, Schwaab, Mack, Blumenthal & Evans

[57] ABSTRACT

A device for draining pressurized liquid from a steam turbine to a low pressure reservoir. The device comprises: an inlet container and an outlet container for storing liquid in their lower parts; drain lines for conveying liquid from the steam turbine to an upper part of the inlet container; a first pipe for maintaining the inlet container at a higher pressure than the outlet container with a head of a first liquid column which leads the liquid from the lower part of the inlet container to the upper part of the outlet container; and a second pipe for maintaining the outlet container at a higher pressure than the low pressure reservoir with a head of a second liquid column which leads the liquid from the lower part of the outlet container to the low pressure reservoir.

18 Claims, 2 Drawing Sheets

LIQUID DRAINING DEVICE FOR A STEAM TURBINE

BACKGROUND OF THE INVENTION

1. Field of the Invention

This invention relates to a device for draining liquid from a steam turbine, which is particularly suitable for use with a geothermal steam turbine utilizing wet steam.

2. Description of the Prior Art

Liquid droplets are inevitably generated in a steam turbine, especially in the lower pressure part. The droplets do not assist in driving the turbine, and they have a negative effect on efficiency. Moreover, the droplets cause erosion on rotating parts such as rotor blades. The problem is especially severe in the case of geothermal steam turbines because the original steam utilized has a high wetness content.

A conventional manner of draining liquid from a turbine is to discharge the liquid from different pressure stages of the turbine through orifices in the pipes. However, some of the steam is inevitably discharged with the liquid through the orifices, and this steam leakage obviously lowers the efficiency of the turbine. Moreover, impurities contained in the steam, such as FeS and $FeS_2$, accumulate on the orifices, and the orifices are plugged during the operation of the steam turbine. It is a severe problem, especially in geothermal steam turbines because of the presence of large amounts of impurities in the steam.

SUMMARY OF THE INVENTION

An object of this invention is to provide a device for draining liquid from a steam turbine, minimizing the loss of steam and alleviating the problem of plugging.

Another object is to provide a device for draining liquid from a steam turbine, arranged in a limited space.

A further object of this invention is to provide a method of draining liquid from a steam turbine while minimizing the loss of steam and avoiding plugging.

According to the invention there is provided a device for draining pressurized liquid from a steam turbine to a low pressure reservoir, the device comprising: an inlet container and an outlet container for storing liquid in their lower parts; drain line means for leading liquid from the steam turbine to an upper part of the inlet container; first column means for maintaining the inlet container at higher pressure than the outlet container with a head of a first liquid column which leads the liquid in the lower part of the inlet container to the upper part of the outlet container; and second column means for maintaining the outlet container at higher pressure than the low pressure reservoir with a head of a second liquid column which leads the liquid in the lower part of the outlet container to the low pressure reservoir.

According to another aspect of the invention there is provided a method of draining pressurized liquid from a steam turbine to a low pressure reservoir, the method comprising steps of: leading liquid from the steam turbine to an upper part of an inlet container; maintaining the inlet container at higher pressure than an outlet container with a head of a first liquid column which leads liquid in the lower part of the inlet container to the upper part of the outlet container; maintaining the outlet container at higher pressure than the low pressure reservoir with a head or a second liquid column which leads the liquid in the lower part of the outlet reservoir to the low pressure reservoir.

Further objects, features and advantages of the present invention will become apparent from the detailed description of the preferred embodiments that follow, when considered with the attached drawings.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DETAILED DESCRIPTION OF THE PREFERRED EBMBODIMENTS

Figure 1:
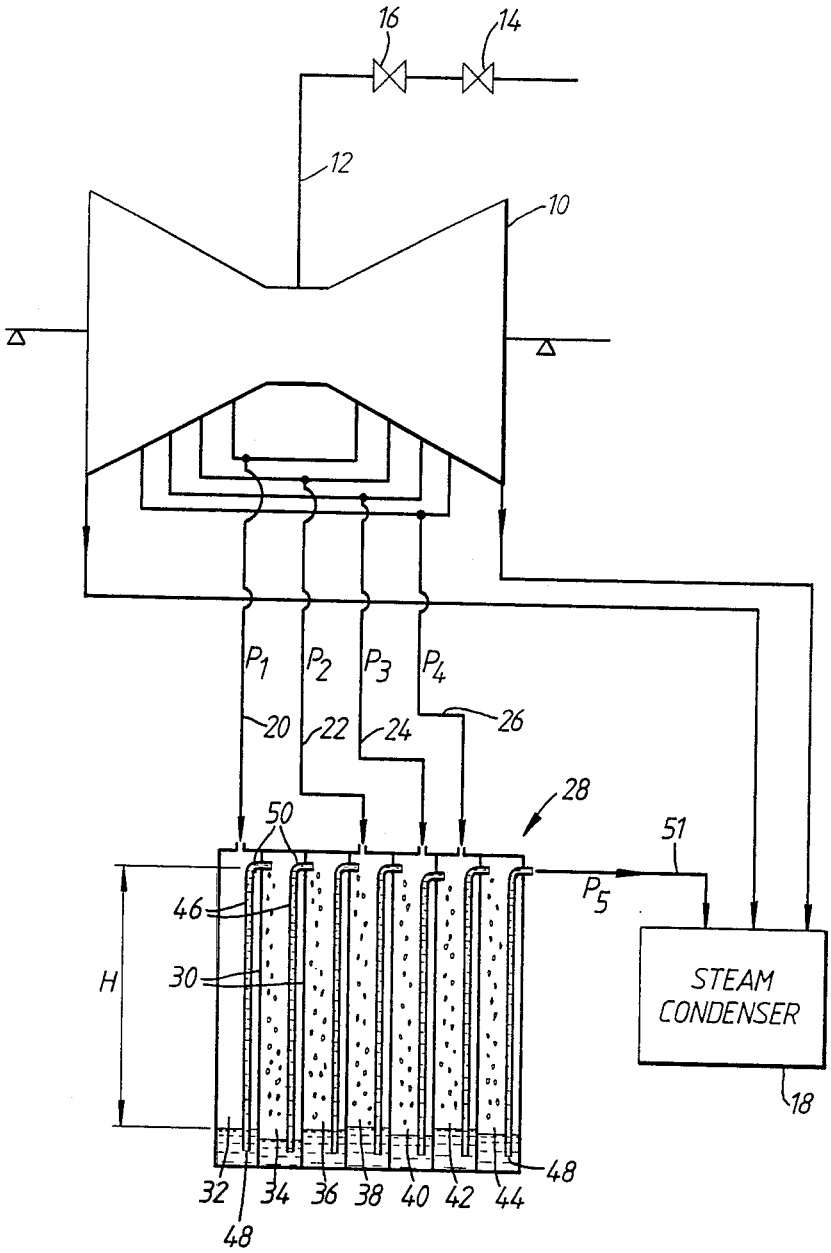
FIG. 1 is a schematic diagram of a first embodiment of this invention.

An embodiment will now be described referring to FIG. 1. Pressurized steam is supplied to a steam turbine 10 through a steam pipe 12. The steam pipe 12 has a stop valve 14 and a regulator valve 16 to control the flow rate of the steam into the turbine 10.

The turbine 10 has a plurality of stages each of which comprises rotor blades and nozzles (not shown). The supplied steam flows first into the first stage, and then into the second, and so on. The steam drives the turbine 10 to rotate while the steam expands in each stage. Th steam out of the last stage of the turbine 10 flows out to a steam condenser 18 where the steam condenses into water.

The turbine 10 shown in FIG. 1 is symmetrical about the center of the turbine 10 in the axial direction where the steam pipe 12 is connected.

First to fourth drain lines 20, 22, 24 and 26 are connected to the outlets of the first to the fourth stages of the turbine 10, respectively. The first to the fourth drain lines 20, 22, 24 and 26 are connected to a container unit 28 to drain the liquid generated in the first to the fourth stages, respectively. The container unit 28 is divided by vertical separation walls 30 into first to seventh containers 32, 34, 36, 38, 40, 42 and 44. The first to seventh containers are arranged in that order, and their pressures are maintained, with certain differences in descending order.

The first to the fourth drain lines 20, 22, 24 and 26 are connected to the top of the first, fourth, fifth and sixth containers 32, 38, 40 and 42, respectively. A vertical pipe 46 is arranged in each of the seven containers. The bottom 48 of the vertical pipe 46 is open near the bottom of the container. The top part 50 of the pipe 46 penetrates the upper part of the vertical wall 30 and is open to the next lower pressure container. The top part of the pipe 46 in the seventh or the outlet container 44 is connected to the steam condenser 18 or a low pressure reservoir via a line 51.

Water is contained in the lower part of the containers and the bottoms 48 of the vertical pipes 46 are submerged in the water. The pipes 46 are filled with water due to the pressure differences between the neighboring containers. For example, the pressure in the first or the inlet container 32 becomes higher than the pressure in the second container 34 by $\gamma$ H, where $\gamma$ (gamma) is the specific gravity of the water in the pipe 46 and H is the height of the pipe 46 above the water level in the first container 32.

Likewise, the pressure difference between the second container 34 and the third container 36, and the pressure difference between the third container 36 and the fourth container 38 are $\gamma$ H.

Therefore, the pressure difference between the first container 32 and the fourth container 38 becomes 3 $\gamma$ H. Since the fourth container 38 is connected to the outlet of the second stage with the second drain line 22, this pressure difference of 3 $\gamma$ H should correspond to the difference between the pressures at the outlets of the first stage $P_1$ and second stage $P_2$.

The difference between the pressures at the outlets of the second stage $P_2$ and the third stage $P_3$ correspond to a single liquid head $\gamma$ H in the pipe 46 in the fourth container 38. Likewise, the difference between the pressures at the outlets of the third stage $P_3$ and the fourth stage $P_4$ is $\gamma$ H. The difference between the pressures at the outlet of the fourth stage $P_4$ and the steam condenser $P_5$ is $2\gamma$ H.

Liquid generated in the turbine 10 flows into the container unit 28 via the drain lines 20, 22, 24 and 26. When the liquid is accumulated in the containers 30, 32, 34, 36, 38, 40, 42 and 44, the water levels in the containers rise, which in turn pushes the liquid up the vertical pipe 46 and drives the liquid to the next lower pressure container. The liquid driven out of the pipe 46 in the seventh container 44 flows into the condenser 18. The height of the liquid column in each vertical pipe 46 in each container is self-determined according to the pressure difference between the corresponding outlets of the turbine stages.

When the load on the turbine 10 is reduced from a rated load to a partial load, the pressure at the outlet of each stage decreases approximately proportionally to the load. The height of water column in each pipe 46 changes in accordance with the change of pressure difference.

When the load on the turbine 10 changes, the pressure differences and the heights of the water columns in the pipes 46 may temporarily not match. However, since liquid flows from the turbine 10 to the container unit 28 continuously, the water columns in the pipe 46 ultimately reach stable positions.

Before the turbine 10 begins operation, the container unit 28 is empty. Then, steam is introduced to the turbine 10. When enough steam flows into the turbine 10, water begins to accumulate in the containers. After the bottoms 48 of the vertical pipes 46, are covered by the accumulated water, water columns are formed in the pipes 46 and the steam through the container unit 28 is sealed.

If, for example, $P_1=4$ [kg/cm$^2$ abs], $H=6$ [m] and $\gamma=1000$ [kg/m$^3$] are assumed, $$P_2 = 4 - 6 \times 1000 \times 3/10^4 = 2.2 \text{ [kg/cm}^2\text{ abs]}$$

is obtained.

If $P_5=0.1$ [kg/cm$^2$ abs] is further assumed, the minimum required height H' of the pipes 46 in the sixth container 42 and the seventh container 44 becomes $$H' = (1.0 - 0.1) \times 10^4/(1000 \times 2) = 4.5 \text{ [m]}$$

According to the embodiment described above, since water stored in the containers and in the vertical pipes 46 seals the steam, the steam leakage from the drain lines is prevented, while excess liquid is drained to the steam condenser 18. Since throttle devices such as orifices are not used, plugging problem due to impurities in the steam will not take place.

The number of the containers arranged in series, the arrangement of the drain lines and the height of the vertical pipe 46 in each container can be arbitrarily chosen in accordance with the design of the steam turbine 10.

Figure 2:
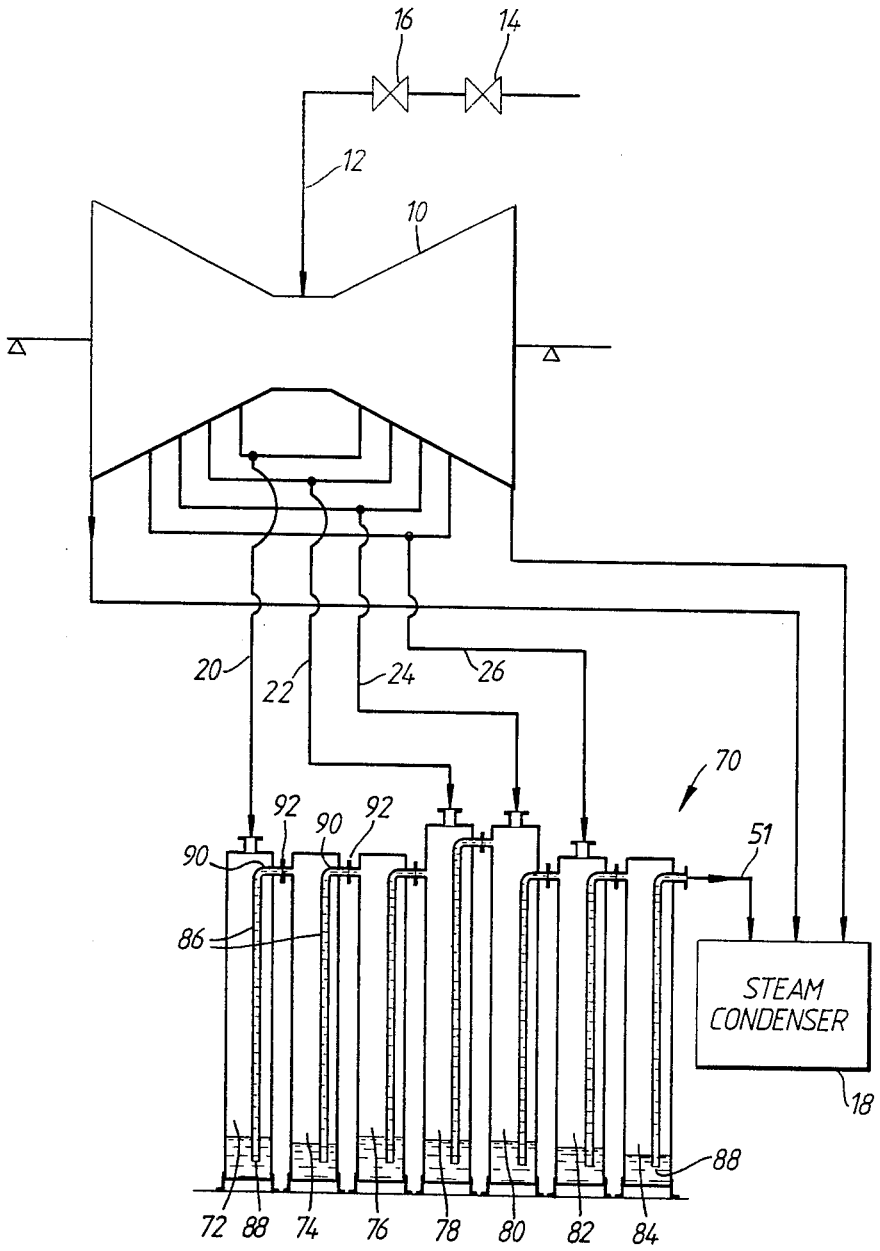
FIG. 2 is a schematic diagram of a second embodiment of this invention.

A second embodiment will now be described referring to FIG. 2. The parts common to the first embodiment are denoted by the same numerals and their descriptions are omitted. The drain lines 20, 22, 24 and 26 are connected to a container unit 70. The container unit 70 includes first to seventh containers 72, 74, 76, 78, 80, 82 and 84, respectively. These containers are separate vessels instead of divided sections of a single vessel as in the first embodiment described above.

The first to the fourth drain lines 20, 22, 24 and 26 are connected to the top of the first, fourth, fifth and sixth containers 72, 78, 80 and 82, respectively. A vertical pipe 86 is arranged in each of the seven containers. The bottom 88 of the vertical pipe 86 is open near the bottom of the container. The top part 90 of the pipe 86 penetrates the upper part of the container wall and is connected to the upper part of the next container via a pipe coupling 92. The top part 90 of the pipe 86 arranged in the seventh or the outlet container 84 is connected to the steam condenser 18.

The operation of this embodiment is the same as that of the first embodiment. In this embodiment, the arrangement of the containers is more flexible since each container is separated. Selection of heights of containers is also flexible, and part of the containers, the fourth and fifth containers 78 and 80, for example, as shown in FIG. 2, may be taller than the others in accordance with the pressure difference between the second and third drain lines 22 and 24.

The foregoing description has been set forth merely to illustrate preferred embodiments of the invention and is not intended to be limiting. Since modification of the described embodiments incorporating the spirit and substance of the invention may occur to persons skilled in the art, the scope of the invention should be limited solely with respect to the appended claims and equivalents.

What is claimed is:

1. A device for draining pressurized liquid from a steam turbine to a low pressure reservoir, the device comprising:

(a) an inlet container and an outlet container, each container having an upper part and a lower part;

(b) means for draining liquid from the steam turbine to the upper part of the inlet container;

(c) means for conveying liquid from the steam turbine to the upper part of the inlet container;

(d) first means for maintaining pressure in the inlet container higher than the pressure in the outlet container and for conveying liquid from the lower part of the inlet container to the upper part of the outlet container; and (e) second means for maintaining pressure in the outlet container higher than the pressure in the low pressure reservoir and for conveying liquid from the lower part of the outlet container to the low pressure reservoir.

2. A device according to claim 1, including an intermediate container having an upper part and a lower part;

first intermediate means for maintaining pressure in the inlet container higher than the pressure in the intermediate container and for conveying liquid from the lower part of the inlet container to the upper part of the intermediate container; and second intermediate means for maintaining pressure in the intermediate container higher than the pressure in the outlet container and for conveying liquid from the lower part of the intermediate container to the upper part of the outlet container.

3. A device according to claim 2, wherein the steam turbine has a first stage of high pressure and a second stage of lower pressure, and the draining means is connected from the first stage of the turbine to the inlet container, and the device further includes a second means for draining liquid from the second stage to the intermediate container.

4. A device according to claim 1, wherein the steam turbine has a first stage of high pressure and a second stage of lower pressure, and the draining means is connected from the first stage of the turbine to the inlet container, and the device further includes a second means for draining liquid from the second stage to the outlet container.

5. A device according to claims 1, 2, 3 or 4, wherein the first maintaining means is in the form of a substantially vertical pipe arranged in the inlet container.

6. A device according to claims 1, 2, 3 or 4, wherein the second maintaining means is in the form of a substantially vertical pipe arranged in the outlet container.

7. A device according to claims 1 or 4, wherein the inlet and the outlet containers are formed in a single vessel divided by a wall.

8. A device according to claims 2 or 3, wherein the inlet, the outlet and the intermediate containers are formed in a single vessel divided by a plurality of walls.

9. A device according to claims 1 or 4, wherein the inlet and the outlet containers are separate vessels.

10. A device according to claims 2 or 3, wherein the inlet, the outlet and the intermediate containers are separate vessels.

11. A method of draining pressurized liquid from a steam turbine to a low pressure reservoir, the method comprising steps of:

(a) conveying liquid from the steam turbine to an upper part of an inlet container;

(b) maintaining the pressure in the inlet container higher than the pressure in the outlet container, the difference in pressure between the container forcing liquid from the lower part of the inlet container to the upper part of the outlet container;

(c) maintaining the pressure in the outlet container higher than the pressure in the low pressure reservoir, the difference in pressure between the outlet container and the low pressure reservoir forcing liquid from the lower part of the outlet container to the low pressure reservoir.

12. A method according to claim 11, wherein the step of maintaining the inlet container at a higher pressure comprises steps of:

maintaining the inlet container at a higher pressure than an intermediate container and conveying liquid from the lower part of the inlet container to the upper part of the intermediate container; and maintaining the intermediate container at a higher pressure than the outlet container are conveying liquid from the lower part of the intermediate container to the upper part of the outlet container.

13. A method according to claims 11 or 12 further comprising the step of dividing the containers by a wall positioned therebetween.

14. A method according to claims 11 or 12 further comprising the step of forming the containers into separate vessels.

15. A method according to claims 11 or 12 wherein the maintaining step includes the step of positioning a pipe substantially vertically in the containers.

16. A method according to claim 11 further comprising the step of creating a pressure difference between the inlet and outlet containers as a function of the height of the a column of liquid in the inlet container times the specific gravity of the liquid.

17. A method according to claim 11 further comprising the steps of:

connecting a first stage of the turbine having a high pressure to the inlet container, and connecting another stage of the turbine having a pressure lower than the first stage to the outlet container.

18. A method according to claim 12 further comprising the steps of:

connecting a first stage of the turbine having a high pressure to the inlet container, and connecting a second stage of the turbine having a pressure lower than the first stage to the intermediate container.

* * * * *